US007700024B1

(12) United States Patent
Teng

(10) Patent No.: US 7,700,024 B1
(45) Date of Patent: Apr. 20, 2010

(54) CORRUGATED CONCRETE WALL PANEL FORM AND METHOD OF CONSTRUCTION THEREOF

(76) Inventor: Jiangming Teng, 4-203 Mitchell Ct., Hanover, PA (US) 17331

( * ) Notice: Subject to any disclaimer, the term of this patent is extended or adjusted under 35 U.S.C. 154(b) by 3 days.

(21) Appl. No.: 11/838,865

(22) Filed: Aug. 14, 2007

Related U.S. Application Data

(60) Provisional application No. 60/822,753, filed on Aug. 17, 2006.

(51) Int. Cl.
*B29C 33/40* (2006.01)

(52) U.S. Cl. ..... 264/219; 264/271.1; 264/333; 249/83; 249/93; 249/94; 249/137; 425/127

(58) Field of Classification Search ..... 264/256, 264/219, 271.1, 333; 429/189; 249/83, 93, 249/94, 137; 425/127
See application file for complete search history.

(56) References Cited

U.S. PATENT DOCUMENTS 3,664,630 A * 5/1972 Maynen et al ..... 249/112
4,832,308 A * 5/1989 Slonimsky et al. ..... 249/78
4,856,244 A 8/1989 Clapp
6,067,757 A 5/2000 Olson
6,324,812 B1 * 12/2001 Drya-Lisiecka ..... 52/783.11
6,481,178 B2 11/2002 Moore, Jr.
6,494,004 B1 12/2002 Zimmerman
6,658,810 B2 12/2003 DeLoach, Sr.

* cited by examiner

*Primary Examiner*—Joseph S Del Sole
*Assistant Examiner*—James Sanders

(57) ABSTRACT

The present disclosure provides a corrugated concrete wall panel form and a method of constructing a prefabricated concrete wall panel thereof. The method comprises the steps of placing a layer of insulation boards horizontally on a flat surface on site or in pre-cast plant; laying and attaching one layer of corrugated metal thin sheets, as the bottom concrete form, on top of the horizontally placed insulation boards; closing the sides of the corrugated metal sheets by peripheral angles as side forms; and then pouring concrete on top of the metal sheets. After concrete hardens the wall structure is ready for erection. This low cost lightweight wall panel system is self-containing and requires only one pour of concrete. It requires no complicated form structure and less labor work for form installation.

10 Claims, 6 Drawing Sheets

(VIEW 1-1)

(VIEW 2-2)

(VIEW 3–3)

CORRUGATED CONCRETE WALL PANEL FORM AND METHOD OF CONSTRUCTION THEREOF

CROSS-REFERENCE TO RELATED APPLICATIONS

This application claims the benefit of provisional application EFS ID: 1160366 Application No. 60822753, Confirmation No.1263 filed 2006 Aug. 17 by the present inventor.

FEDERALLY SPONSORED RESEARCH

Not applicable

SEQUENCE LISTING OR PROGRAM

Not applicable

BACKGROUND OF THE INVENTION

This invention deals generally with building construction and more specifically with the construction of concrete prefabricated basement walls or exterior walls for residential buildings. It relates to a method of fabricating a durable, high-strength, low cost, light weight, thermally efficient, maintenance free, and construction friendly concrete wall panel by using a corrugated thin-sheet-type bottom form permanently attached to the back of the wall panel and requiring only one pour of concrete.

Concrete walls as part of buildings, by their nature, and hurricane proof, are durable, high strength, earthquake, hurricane and flood proof, and fire resistant Concrete walls are widely used for commercial buildings such as office buildings, warehouses, factories, hospitals, theaters, stores and the like. However, traditional exterior wall materials for low-rise residential buildings such as single houses or townhouses are wood, bricks or stones but not concrete.

Three major reasons result in not using concrete exterior walls for residential buildings.

First, the construction and material cost of concrete walls is much higher than that for wooden or masonry walls. Two major construction methods for building concrete walls are cast-in-place and prefabrication.

Cast-in-place concrete wall construction employs either temporary forms or permanent forms. The temporary-forms method involves the construction of forms, either wood or metal, in the exact shape of the vertical walls, and then pouring concrete into the forms. After the concrete hardens, the temporary forms are removed and reused on other walls. On the other hand, the forms in the permanent-form method are not removed and stay in place with the wall permanently. The cost for forms limits the cast-in-place method. Although forms in the temporary-form method can be reused, the construction still involves a lot of labor work for form installation and removal.

Prefabricated concrete walls include tilt-up walls and precast walls. Tilt-up walls are cast in forms on the floor slab and simply are tilted into position. This method needs a large area of very flat surface and is cost effective only in the construction of large buildings. Pre-cast wall panels are made in plants and then shipped to the job sites. The shipping cost for precast panels and erection cost for both methods can be very high.

Second, concrete construction requires wall builders to be knowledgeable in concrete construction and to own or rent heavier construction equipment such as high capacity cranes. Traditionally, builders for low-rise residential buildings are familiar with wood or masonry construction, which are relatively simple and light compared with concrete construction.

Third, traditional concrete walls used in commercial buildings are made in a 3-layer sandwich structure with an insulation layer in between two concrete layers. It is not suitable for residential building because it is hard to attach interiors and utility conduits to the interior concrete layer of the walls.

Many prior art teachings show how to build tilt-up or precast concrete wall panels. For example, U.S. Pat. No. 4,856,244 to Clapp (1989), U.S. Pat. No. 6,067,757 to Olson (2000), U.S. Pat. No. 6,494,004 B1 to Zimmerman (2002), U.S. Pat. No. 6,481,178 B2 to Moore Jr., and U.S. Pat. No. 6,658,810 B2 to Deloach, Sr. All of them are creative in some ways. However, the present invention teaches a more efficient way of producing tilt-up concrete wall panels.

SUMMARY OF THE INVENTION

The preferred embodiment is a load bearing concrete exterior wall or basement wall for residential buildings. The wall panel dimension is 10 feet wide by 12 feet high. It has one 2-inch thick concrete exterior shell or layer and six 5.5-inch deep concrete ribs distributed 2 feet apart on center at the back of the wall. The ribs run all the way from the top to the bottom of the wall.

In accordance with the preferred embodiment in this invention, as a load bearing concrete exterior wall for residential buildings, the present invention eliminates or partly solves the existing problems associated with construction of prefabricated concrete wall panels for residential buildings.

The bearing strength of concrete is very high. Traditional concrete walls are of a rectangular cross section, which has a minimum thickness of 6 inches for the load bearing case. The compressive bearing capacity of traditional concrete walls is far more beyond what is necessary for a residential building. The reasons for the unnecessarily large cross section of are concrete buckling and shrinkage issues and also the limitation of the construction technology. Unnecessary large cross sections of the walls cause unnecessary additional weight. For prefabricated walls, the handlings of the walls during manufacture, shipping and erection requires large cranes and trucks just due to the weight of concrete walls. In addition, it is a waste of materials such as concrete and reinforcement.

The present invention offers a much more reasonable structural sectional profile, which includes a thin 2-inch thick exterior layer of concrete and multiple back ribs. The ribs at back prevent the buckling of the panel and assure the bearing capacity is still good for light duty loads such as office or residential buildings. The integrated metal thin sheet along with mesh reinforcement can solve concrete shrinkage problem. The reduced sectional area means lighter weight and material saving. The lightweight wall panels don't need heavy construction equipment for handling.

Besides the savings of materials and handling cost, the present invention doesn't require complicated construction technology. There is no elaborate formwork and reinforcement installation. Therefore there is no need for highly trained workers. Just a one-time simple wall assembly and a single pour of concrete will do the work.

The beauty of this invention is not limited to that described above. This prefabricated wall panel can be made in place and be erected by a tilt-up method and save even more. This assembly includes metal thin sheets as the bottom forms setting on rigid insulation boards, which don't require a perfectly flat surface such as the top of the floor slab required by traditional tilt-up construction. Any flat area around the job site can be used for this construction.

In addition, the corrugated structure with insulation boards attached at the back ribs produces a fully insulated wall panel with excellent thermal efficiency. The large air chambers formed in between the front concrete shell and the back insulation boards are considered an additional thermal insulation layer. This configuration also allows for running the utility conduits inside of the vertical chambers, and the vertical air chambers provide channels for weep water drained out of the wall structure. The interiors can be attached onto the rigid insulation boards later on.

Thus the present invention furnishes a prefabricated concrete wall system. By this invention, construction of a concrete residential building unit can be faster, easier and cost less than before.

DESCRIPTION OF THE REFERENCE NUMERALS OF THE DRAWING

10 Concrete
11 Tilt-up Riggings
12 Corrugated Metal Sheets
13 Rigid Insulation Boards
14 Steel C-Channels
15 Dry Wall (sheet rock)
16 Wood Studs
17 Steel Welded Meshes
18 Fasteners with Welded-Hex-Head Top Stud and Sharp Tip End
19 Steel Reinforcement Bars
20 Side Angles
21 End Angles
22 Bolts to Connect End Angles to Side Angles
23 General Flat Horizontal Work Surface
24 Ply Wood
25 Hex Head Coil Threaded Bolts
26 Hex Head Nuts
27 Corrugations

DETAILED DESCRIPTION OF THE PREFERRED EMBODIMENTS

Figure 1:
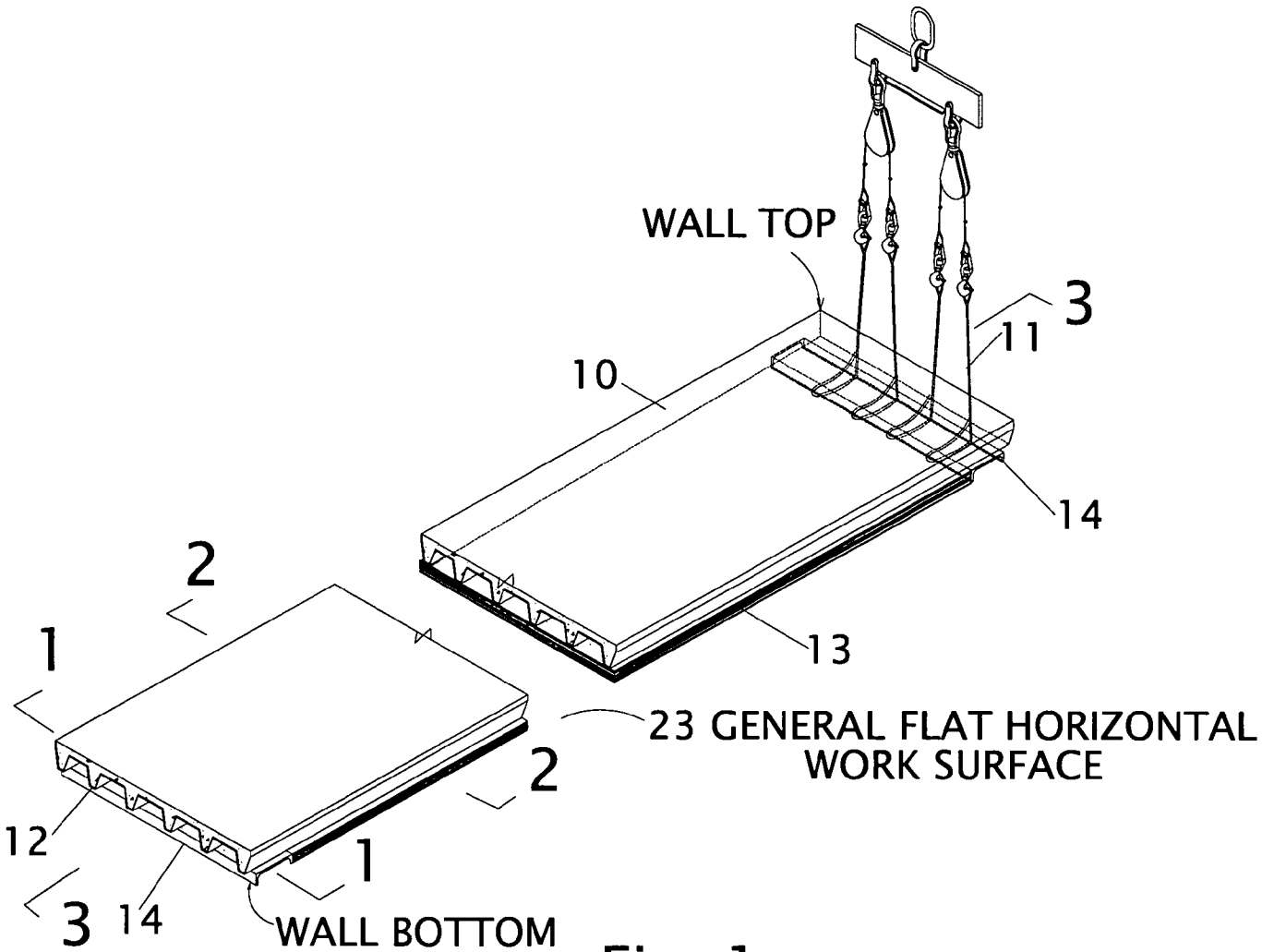
FIG. 1 is a perspective view of a preferable embodiment of the invention. A finished wall panel is positioned horizontally on top of a work surface. Tilt-up riggings have been installed and ready for erection.

FIG. 1 depicts a wall panel, which is 10 feet wide and 12 feet high, built with the method described in the present invention. A general flat horizontal work surface 23 is prepared in a preferably dry, clean and well illuminated location at the job site. Flat horizontal work surface 23 doesn't need to be perfectly level.

The construction of the wall panel starts from placing steel C-channels 14 with channel web side facing up against the bottoms of the corrugations on metal sheet 12. C-channels 14 are located at both ends of the wall panel. The heights of the flange of steel channels 14 should be the same as that of insulation board 13. C-channels 14 serve four purposes. First, C-channels 14 work as the end supports of the bottom form during the constructing of the wall panel before concrete 10 is poured and gets strength. The bottom form, which is a corrugated metal sheet 12, will be described later. Second, C-channels 14 will be used to erect the wall panel after concrete 10 hardens. Third, the wall panel needs more stiffness in the horizontal direction, and C-channels 14 can add required stiffness. Fourth, future utility conduits can run through C-channels 14 by its web side cavity later when the house is built.

Rigid insulation boards 13 are laid horizontally on the work surface 23 against the bottom of the corrugations on metal sheet 12. Rigid insulation boards 13 can be 3 or 4 inches thick which is the same as the flange height of C-channel 14. Rigid insulation boards 13 should be tailored into the required dimensions according to the panel profile.

Figure 2:
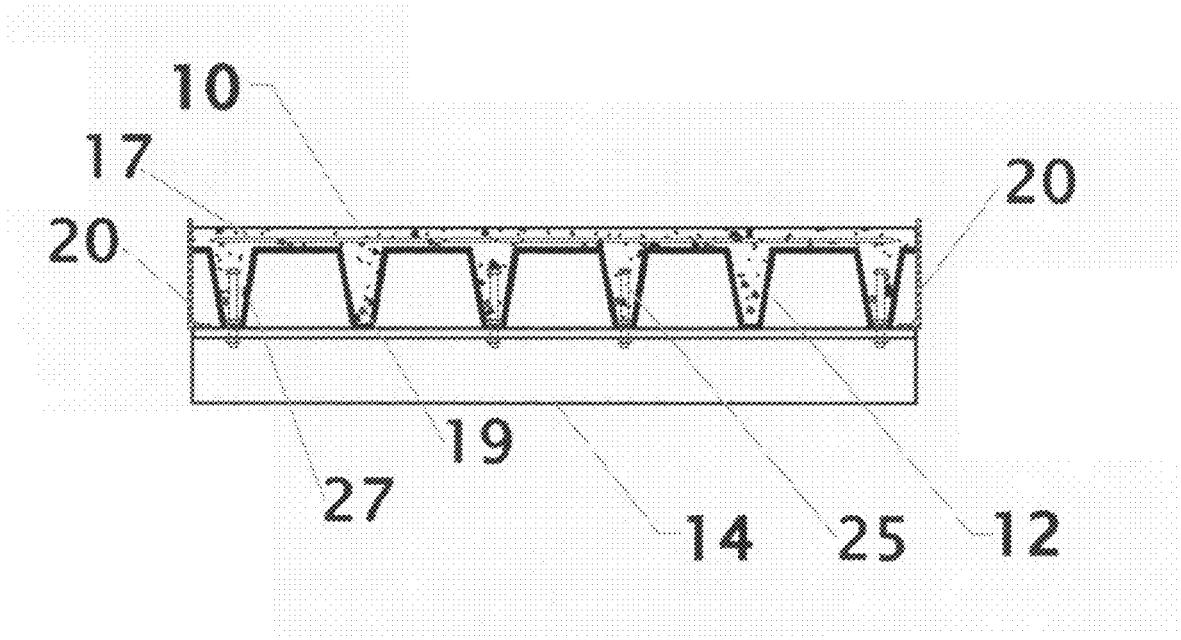
FIG. 2 is a sectional view in detail of the portion indicated by the section line 1-1 in FIG. 1. It shows how a corrugated metal sheet is connected to a steel C-channel. Angles at edges as side forms are also shown in this drawing.
Figure 4:
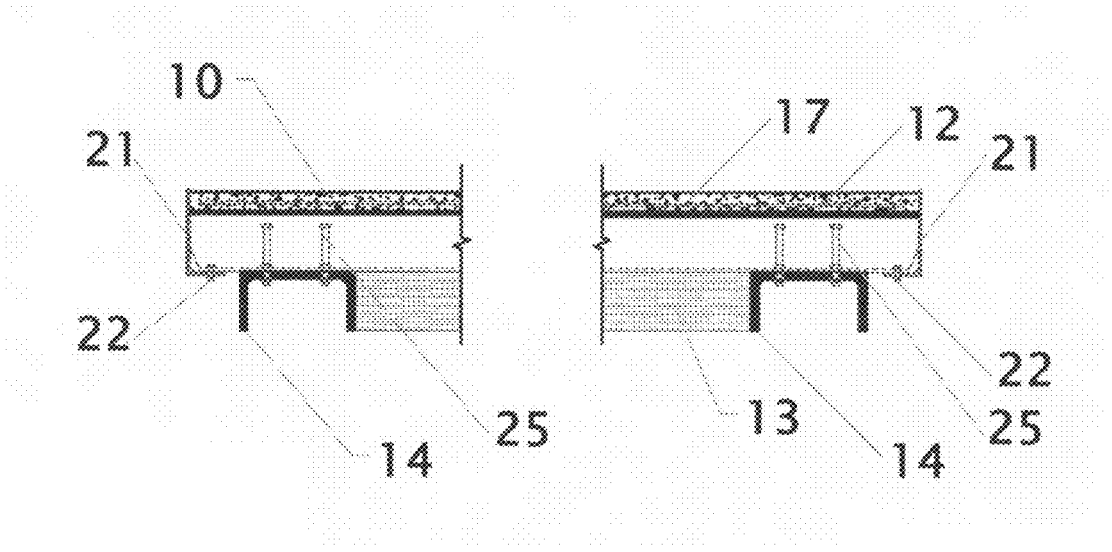
FIG. 4 is a fragmentary view in detail of the portion indicated by the section line 3-3 in FIG. 1. It shows the detailed longitudinal side view of the wall panel. The steel channels at the top and bottom of the wall panel are connected to the corrugated metal sheet by bolts.

As shown on FIG. 2 and FIG. 4, a corrugated metal sheet 12 is bolted from its corrugation bottom to the top of steel C-channels 14 by sixteen of hex head coil threaded bolts 25, which are four bolts 25 in a row and two rows for each end of the wall panel.

Figure 5:
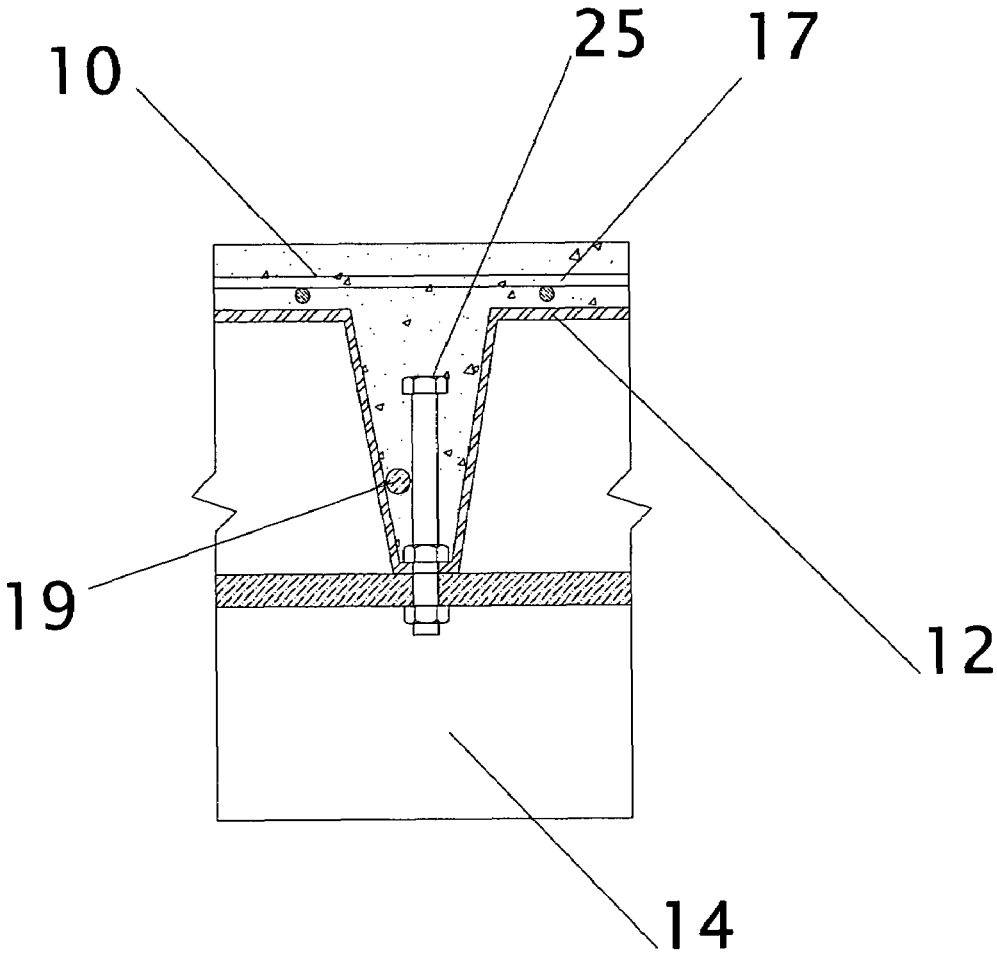
FIG. 5 is a detailed view for a coil threaded hex head bolt and two nuts connecting a corrugated metal sheet to a steel C-Channel.

As shown in FIG. 5, coil threaded bolt 25 has a welded hex head at one end embedded into concrete. The other end of bolt 25 is coil-threaded and connected to C-channel 14. Two hex head nuts 26 for each stud are used to fasten corrugated metal sheet 12 and C-channel 14 together.

Figure 3:
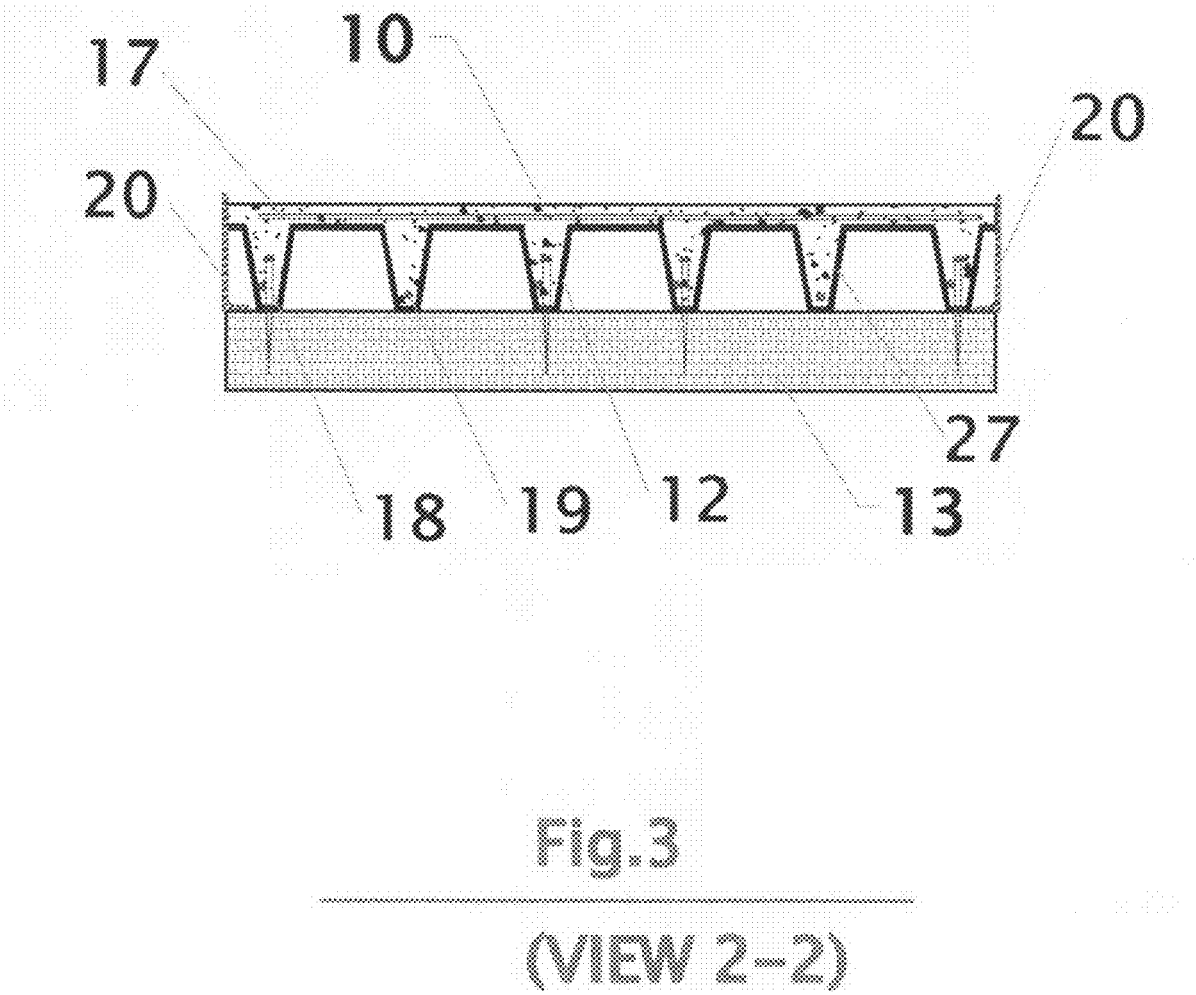
FIG. 3 is a sectional view in detail of the portion indicated by the section line 2-2 in FIG. 1. It shows how an insulation board is connected to a corrugated metal sheet by nail-like fasteners. Angles as side forms are also shown in this drawing.

As shown on FIG. 3, on the top of insulation boards 13, corrugated metal sheet 12 is then nailed down to insulation boards 13 by using Fasteners 18 with welded hex head top stud and a sharp tip end. There are four rows of fasteners 18 per panel evenly distributed longitudinally along the panel at 4 feet on center. One row is located at each end of the wall panel and the other two rows are evenly distributed in the middle. There are four studs 18 in each row, for a total of sixteen. The Fasteners 18 have upper and lower two parts. The upper part with welded hex head is embedded in concrete. The lower part with sharp tip works with insulation boards 13 as anchor attachment. During installation, the lower part of studs 18 should penetrate into insulation board 13 and the upper part should protrude from the top of corrugated sheet 12 for future concrete bonding.

Corrugated metal sheet 12 works as a permanently attached bottom form for the pouring of concrete 10. Sheets 12 will stay in place as part of the wall panel reinforcement for concrete shrinkage. The materials of sheets 12 can be steel or rigid plastics but not limited to those materials. The thickness of corrugated metal sheet 12 can be around 22 ga or thicker for steel. In this embodiment, sheets 12 have six corrugations 27, which are spaced 2 feet apart on center for a 10-foot wide panel. The corrugations 27 are 5.5 inches deep starting from the flat bottom of the panel.

Considering the labor spent and time consumed for installing and removing the forms when using a reusable mold, the cost of a wall panel constructed according to the present invention is actually lower.

As shown in FIG. 3, two side angles 20 are placed on top of two steel channels 14 along the edges of corrugated sheets 12 as concrete side forms. Two steel channels 14 at the wall panel ends serve as supports for the two side angles 20. To form a concrete top shell of 2-inch thickness, side angle 20 can be in the size of 4 inches wide by 8 inches high.

As shown in FIG. 4, two end angles 21 serve as concrete end forms and are bolted by bolts 22 to side angle 20. End angle 21 can be the size of 4 inches by 8 inches too.

As shown in FIG. 2 and FIG. 3, reinforcement bars 19 are placed in each bottom of corrugation 27 as longitudinal reinforcement. Steel welded mesh 17 is placed on top of sheet 12 as concrete shrinkage reinforcement.

As shown in FIG. 1, when the form assembly is finished. Concrete 10 will be poured to the assembly. After concrete 10 hardens and cures enough, end angles 21 and side angles 20 will be removed. Tilt-up rigging 11 will be installed as shown for tilt up erection.

Figure 6:
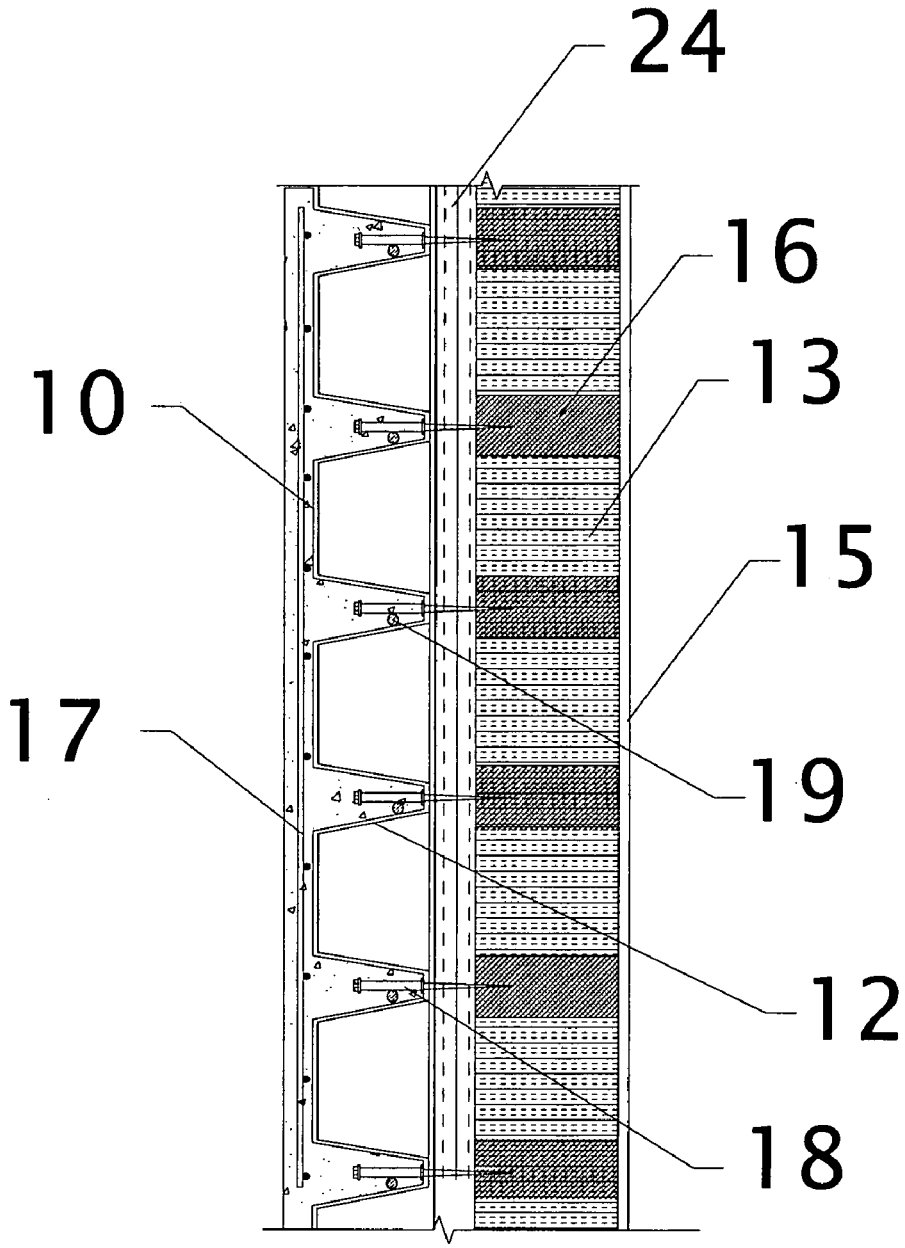
FIG. 6 is a cross section view of a finished concrete non-load bearing panel, which is made from concrete and corrugated metal sheets, serving as an architectural exterior cladding and being attached to a load bearing wood frame.

FIG. 6 shows one of the other applications of this invention. Corrugated concrete panel serves as an architectural non-load-bearing shell for a wood frame panel. Fasteners 18 connect corrugated sheets 12, plywood 24 and wood studs 16 together. Wood studs 16 are the load-bearing structural members for the building constructed.

The present invention offers a method for constructing and erecting a prefabricated fully insulated concrete wall panel, which is simple, lightweight and cost efficient. Regarding construction, the invention lowers the labor cost for installing and removing forms. Construction is speeded up by this invention.

Note that the preferred embodiment of this invention as shown is merely one of many applications. Various changes may be employed in the dimensions, functions and arrangements of the parts; equivalent means may be substituted for those illustrated and described; and certain features may be used independently from others without departing from the spirit and scope of the invention as defined in the following claims.

What is claimed is

1. A form for fabricating a tilt-up concrete wall panel comprising:

a) a horizontally placed thin sheet of rigid material of sufficient size to be the permanent bottom form for said concrete wall panel, wherein said thin sheet has a plurality of downward corrugations that extend from the top to the bottom of said concrete wall panel;

b) a plurality of side frame members closing the edges of said thin sheet and working as side forms c) a plurality of C shape channels spaced evenly at the bottom of said thin sheet and with web sides connected to said corrugations, whereby said C shape channels provide lateral stiffness to said wall panel;

d) a plurality of thermal insulation boards attached to the back of said corrugations;

e) a plurality of fasteners connecting said thin sheet to said rigid insulation boards, wherein each said fastener comprises an elongated stud, an enlarged head and a sharp tip, each of said fasteners penetrating half of its length into said insulation board, whereby said fasteners can bond with concrete and attach to said insulation boards at the same time; and f) a plurality of threaded bolts and nuts connecting said thin sheet to said C shape channels, wherein each said threaded bolt has an elongated stud, installed with threaded end proximate said C shape channel and two nuts threaded on and another end bonded with concrete.

2. The form for fabricating a tilt-up concrete wall panel of claim 1 wherein said thin sheet is made from a plurality of thin sheet pieces of smaller size and of the same corrugation profile.

3. The form for fabricating a tilt-up concrete wall panel of claim 1 wherein said corrugations are of shapes including upside down trapezoidal shape and rectangular shape.

4. The form for fabricating a tilt-up concrete wall panel of claim 1 wherein said corrugations are spaced from 1 foot to 6 feet apart on center, of a height from 2 inches to 8 inches and a width from 1 inch to 6 inches, whereby said concrete wall panel obtains sufficient structural strength, structural stability, predetermined thermal insulation and a channel for releasing weep water.

5. The form for fabricating a tilt-up concrete wall panel of claim 1 wherein said thin sheet is of a thickness from 9 Ga (0.1495 inch) to 26 Ga (0.0179 inch).

6. The form for fabricating a tilt-up concrete wall panel of claim 1 wherein said rigid materials include metals and rigid plastics.

7. The form for fabricating a tilt-up concrete wall panel of claim 1 wherein a plurality of said side frame members include two side angles and two end angles with a height sufficient to make the top concrete shell of said concrete wall panel.

8. The form for fabricating a tilt-up concrete wall panel of claim 1, further comprising:

a steel welded mesh; at least one steel reinforcement bar embedded in each corrugation.

9. A method for fabricating a tilt-up concrete wall panel form comprising the steps of:

a) placing two C-channels horizontally on a flat surface and the web sides of said C-channels facing up;

b) laying a layer of wall insulation boards horizontally in between two said C-Channels on said flat surface;

c) laying and attaching one layer of corrugated thin sheet of rigid materials on top of horizontally placed said wall insulation boards and said channels, to be the bottom form for the pouring of a wall panel;

d) closing the sides of the corrugated metal sheet by using peripheral angles as side forms;

e) placing at least one steel reinforcement bar into each corrugation of said sheet; and f) placing a layer of steel welded mesh on the top of said sheet.

10. A method for constructing a tilt-up or pre-cast concrete wall panel and tilting it up comprising:

a) placing two C-channels horizontally on a flat surface and the web sides of said C-channels facing up;

b) laying a layer of wall insulation boards horizontally in between two said C-channels on said flat surface;

c) laying and attaching one layer of corrugated thin sheet of rigid materials on top of horizontally placed said wall insulation boards and said channels, to be the bottom form for the pouring of a wall panel;

d) closing the sides of the corrugated metal sheet by using peripheral angles as side forms;

e) placing at least one steel reinforcement bar into each corrugation of said sheet;

f) placing a layer of steel welded mesh on the top of said sheet g) pouring concrete on the top of said sheet; and h) using a C-channel and riggings for tilting up after concrete hardening.

* * * * *